US009339088B2

(12) United States Patent
Tang

(10) Patent No.: US 9,339,088 B2
(45) Date of Patent: May 17, 2016

(54) TAPE FOR DERLIN ZIPPER

(71) Applicant: Shen Zhen Hua Sheng Da Zipper Co., Ltd., Shenzhen (CN)

(72) Inventor: Zhiqiang Tang, Shanghai (CN)

(73) Assignee: Shen Zhen Hua Sheng Da Zipper Co., Ltd. (CN)

( * ) Notice: Subject to any disclaimer, the term of this patent is extended or adjusted under 35 U.S.C. 154(b) by 0 days.

(21) Appl. No.: 14/555,680

(22) Filed: Nov. 27, 2014

(65) Prior Publication Data

US 2015/0272285 A1 Oct. 1, 2015

(30) Foreign Application Priority Data

Mar. 26, 2014 (CN) ..... 2014 1 0117840

(51) Int. Cl.

| | |
|---|---|
| ***A44B 19/54*** | (2006.01) |
| ***A44B 19/24*** | (2006.01) |
| ***D03D 1/00*** | (2006.01) |
| ***A44B 19/34*** | (2006.01) |
| ***D03D 3/00*** | (2006.01) |
| ***D03D 13/00*** | (2006.01) |
| *D03D 25/00* | (2006.01) |

(52) U.S. Cl.

CPC ..... *A44B 19/346* (2013.01); *D03D 1/00* (2013.01); *D03D 3/005* (2013.01); *D03D 13/004* (2013.01); *D03D 13/006* (2013.01); *D10B 2501/0631* (2013.01)

(58) Field of Classification Search

CPC ..... A44B 19/346; A44B 19/40

See application file for complete search history.

(56) References Cited

U.S. PATENT DOCUMENTS

| | | | | | |
|---|---|---|---|---|---|
| 1,734,165 | A | * | 11/1929 | French | A44B 19/346 139/384 B |
| 2,061,073 | A | * | 11/1936 | Hendley | A44B 19/346 139/384 B |
| 2,296,880 | A | * | 9/1942 | Smith | A44B 19/12 24/391 |
| 2,373,835 | A | * | 4/1945 | Jones | A44B 19/346 139/384 B |
| 2,408,850 | A | * | 10/1946 | Hendley | A44B 19/346 139/384 B |
| 3,136,343 | A | * | 6/1964 | Firing | A44B 19/346 139/431 |
| 3,892,262 | A | * | 7/1975 | Dahlmann | A44B 19/54 139/116.1 |
| 3,961,652 | A | * | 6/1976 | Hasuda | A44B 19/34 139/384 B |
| 4,216,805 | A | * | 8/1980 | Akashi | A44B 19/346 139/384 B |

(Continued)

*Primary Examiner* — Bobby Muromoto, Jr.

(74) *Attorney, Agent, or Firm* — Garcia-Zamor IP Law; Ruy M. Garcia-Zamor

(57) ABSTRACT

A tape for derlin zipper comprises a plurality of warp yarns and a plurality of weft yarns interwoven with the warp yarns, the weft yarns are divided into a plurality of groups of weft yarns. The tape for derlin zipper includes two groups of clamping warp yarns, each group of clamping warp yarns includes a first clamping warp yarn and at least one second clamping warp yarn. The first clamping warp yarn and the second clamping warp yarn wriggle along a length of the tape to exchange positions with each other, and to form a plurality of clamping spaces. Each group of weft yarns passes through the clamping space with the first clamping warp yarns locate upon the group of weft yarns and the second clamping warp yarns locate under the group of weft yarns. A hollow area is formed between each two neighboring groups of weft yarns.

15 Claims, 5 Drawing Sheets

(56) References Cited

U.S. PATENT DOCUMENTS 4,354,532 A * 10/1982 Tsubata ..... A44B 19/346 139/384 B
4,539,733 A * 9/1985 Yoshida ..... A44B 19/346 24/394
5,983,465 A * 11/1999 Wakai ..... A44B 19/34 24/392
6,418,975 B1 * 7/2002 Shimono ..... A44B 19/346 139/384 B
6,742,226 B2 * 6/2004 Matsuda ..... A44B 19/343 24/381
7,293,434 B2 * 11/2007 Ikeguchi ..... A44B 19/40 66/193
9,089,189 B1 * 7/2015 Davis ..... A44B 19/346
9,169,583 B2 * 10/2015 Hasegawa ..... A44B 19/346
2002/0092139 A1 * 7/2002 Horikawa ..... A44B 19/346 24/381
2003/0110602 A1 * 6/2003 Matsuda ..... A44B 19/343 24/436
2004/0173276 A1 * 9/2004 Horikawa ..... A44B 19/346 139/384 B
2004/0250384 A1 * 12/2004 Arai ..... A44B 19/34 24/432
2005/0108950 A1 * 5/2005 Bigelow ..... B29C 70/222 52/2.11
2007/0089466 A1 * 4/2007 Ikeguchi ..... A44B 19/40 66/195
2008/0289156 A1 * 11/2008 Lewis ..... A44B 19/346 24/381
2012/0272488 A1 * 11/2012 Wang ..... A44B 19/32 24/389
2013/0177734 A1 * 7/2013 Hasegawa ..... A44B 19/346 428/99
2013/0185903 A1 * 7/2013 Matsuzawa ..... A44B 19/346 24/415
2013/0298358 A1 * 11/2013 Nishida ..... A44B 19/346 24/393
2014/0068899 A1 * 3/2014 Kojima ..... A44B 19/26 24/399
2014/0245574 A1 * 9/2014 Miyazaki ..... A44B 19/24 24/432

* cited by examiner

TAPE FOR DERLIN ZIPPER

BACKGROUND

1. Technical Field

The present disclosure generally relates to zippers, and especially to a tape for a derlin zipper. A plurality of hollow areas with stable size and position are formed in the tape during a process of weaving the tape, which results of improvement of a bonding force between teeth and the tape.

2. Description of Related Art

A traditional tape for a derlin zipper generally includes a thick filler cord. During a process of injection molding of the zipper, melt derlin material is injected into a zipper mould, and is focused at two sides of the tape. After a cooling action, the solidified derlin material forms teeth, and clamps the thick filler cord of the tape, and the teeth fixes with the tape. However, because the teeth of the zipper are made of derlin material, and plus the teeth are fixed with the tape only by an enwrapping force between the teeth and the filler cord of the tape, bonding capacity between the tape and the teeth is week. In addition, the derlin zipper is usually used in feather dresses which are worn in cool seasons, the derlin material is prone to be fragile in a low temperature. As a result, there is a risk that the teeth are prone to escape from the tape.

China's State Intellectual Property Office (SIPO) had published a Chinese patent of YKK corporation on Feb. 1, 2006 (the applicant number of the patent is 200510084983.2, and the title of the patent is "zipper tooth and method of manufacturing the same"). The target of the patent is to improve the intensity of a zipper. The technical proposal is described as following: a warp yarn exclusion area is formed at an edge of a tape (near a center filler cord of the tape), and the warp yarn exclusion area is formed by way of dissolution of water soluble yarns during a process of coloration of the tape. The water soluble yarns are preset in the warp yarn exclusion area. During a process of injection molding of the zipper, the injection material penetrates the tape via the warp yarn exclusion area, so that the zipper tooth fixes with the tape firmly, which results of improvement of the intensity of the zipper.

Although the warp yarn exclusion areas are formed in the tape, there is difficulty and insufficiency for the injection material to penetrate the tape due to the existence of the weft yarns. As a result, the improvement of the bonding intensity between the zipper tooth and the tape is limited. Further, the number of the warp yarns for fixing the filler cord is reduced due to the existence of the warp yarn exclusion areas, thus there is a risk that the position of the filler cord is unstable, which results deviation of the position of the tape in the zipper mould, and influences normal production of the zipper.

In addition, SIPO had issued another patent (the applicant number of the patent is 200910057534.7, and the title of the patent is "Tape") on Jan. 5$^{th}$, 2011. The technical proposal of the patent is described as following.

With reference to FIG. 5, a row of positioning holes 4 are formed in a bonding area of the tape by change of the structure configuration of the warp yarns (31, 32, 33, 34, 35, 36, 37, 38, 39, 310, 311 . . . ). In detail, the warp yarns 33, 35 wriggle up one of the weft yarns and down a next one of the weft yarns (21, 22, 23, 24, 25, 26, 27, 28) in order. The warp yarn 34 between the warp yarn 33 and the warp yarn 35 wriggles down three of the weft yarns and up next three of the weft yarns in order. Meanwhile, the warp yarns 36, 38 are organized as an inverse order of the warp yarns 33, 35, and the warp yarn 37 is organized as an inverse order of the warp yarn 34. That is, the warp yarns 36, 38 wriggle down the one of the weft yarns and up the next one of the weft yarns in order. The warp yarn 37 wriggles up the three weft yarns and down the next three weft yarns.

Because of the effect of the tension of the warp yarns, binding places between the weft yarns 21, 23 and the warp yarns 33, 35, 36, 38 move close to the weft yarn 22. Similarly, binding places between the weft yarns 24, 26 and the warp yarns 33, 35, 36, 38 move close to the weft yarn 25. Simultaneously, because of the effect of the tension of the weft yarns, binding places between the warp yarns 33, 35 and the weft yarns 21, 23, 24, 26 move close to the warp yarn 34. Similarly, binding places between the warp yarns 36, 38 and the weft yarns 21, 23, 24, 26 move close to the warp yarn 37. As a result, the positioning holes 4 are formed between the warp yarns 35, 36, and are formed between the weft yarns 23, 24. With the process of weaving of the tape, one row positioning holes 4 are formed continuously between the warp yarns 35, 36 on the bonding area of the tape. The row positioning holes 4 evenly space from each other with three weft yarns, and are uniform in size.

During the process of injection molding of the zipper, the injection material penetrates the tape via the positioning holes 4, which results of improvement of bonding force between the tape and the teeth 1 of the zipper.

According to the patent CN200910057534.7, the positioning holes 4 are formed by the effect of the tension of warp yarns and the weft yarns. However, because the warp yarns of the tape are arranged in order, when the weave of the tape is finished, the effect of the tension generated during the weaving process of the tape disappears and fails to influence the warp yarns. As a result, the warp yarns 35, 36 located two sides of the positioning holes 4 trends to move toward centers of the positioning holes 4, especially when the tape undergoes an exterior force.

It is known, after the weave of the tape, there are many procedures for producing the zipper before injection molding, including stereotyping of the tape, strip winding, coloration, drying, tooth arrangement and so on. Each procedure undergoes a plurality of hanging parts, such as roller wheels, clamping rollers, and undergoes a plurality of times of the exterior force for pressing the tape and slackening the tape, plus the effect of shrink of the weft yarns during the process of coloration, the warp yarns 35, 36 located two sides of the positioning holes trends to move toward centers of the positioning holes 4 easily. As a result, after the procedures, the sizes of the positioning holes become smaller than that of the original positioning holes that are formed during the weave of the tape, which brings uncertainty for the injection material to penetrate the tape, and influences the bonding force between the teeth and the tape.

Therefore, a need exists in the industry to overcome the described problems.

SUMMARY

The disclosure is to offer a tape for a derlin zipper, and sizes and positions of positioning holes formed during a process of weaving the tape are unchangeable during all procedures of producing the derlin zipper, which improves a bonding capacity between a tooth and the tape of the derlin zipper.

A tape for a derlin zipper includes a plurality of warp yarns and a plurality of weft yarns interwoven with the plurality of warp yarns. The plurality of weft yarns are divided into a plurality of groups of weft yarns. The plurality of warp yarns includes at least one group of clamping warp yarns arranged in series, and each group of the clamping warp yarns includes a first clamping warp yarn and at least one second clamping warp yarn. The first clamping warp yarn and the second clamping warp yarn intersect with each other at positions between each two neighboring groups of weft yarns, to generate a plurality of intersections formed collectively by the first clamping warp yarn and the second clamping warp yarn. A clamping space is formed between each two neighboring intersections. Each group of weft yarns passes through the corresponding clamping space with the first clamping warp yarn located upon the group of weft yarns and the second clamping warp yarns located under the group of weft yarns, and is clamped by the first clamping warp yarn and the second clamping warp yarn tightly to form a weft yarn beam. A hollow area is formed between each two neighboring weft yarn beam.

Preferably, the plurality of warp yarns includes two groups of clamping warp yarns arranged in series, and one row of hollow areas are formed between the two groups of the clamping warp yarns.

Preferably, a number of the second clamping warp yarn is four, and the first clamping warp yarn and the plurality of groups of weft yarns collectively clamps the four second clamping warp yarns tightly.

Preferably, a number of each group of weft yarns is less than a number of weft yarns covered by a tooth of the derlin zipper.

Preferably, a number of each group of weft yarns is three.

Advantageously, continuous transpositions and intersections between the first clamping warp yarn and the second clamping warp yarn ensure fixation and fastness of the positions of the first clamping warp yarn and the second clamping warp yarn. As a result, even if the tape undergoes a plurality of procedures before the process of injection molding of the derlin zipper, the first clamping warp yarn and the second clamping warp yarn fail to move, which results of stability of the positions and sizes of the hollow area.

In addition, during the process of injection molding of the derlin zipper, the liquid derlin material flows into the hollow area. After a cooling action, the liquid derlin material in the hollow area forms the post integrated with the tooth, and penetrates the tape. As a result, a bonding force between the tooth and the tape is guaranteed to improve greatly, which prevents the tooth escaping from the tape effectively. Manufacturers need not worry about movement of the warp yarns during the manufacturing procedures of the tape, and the size and the position of the hollow area are unchangeable.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
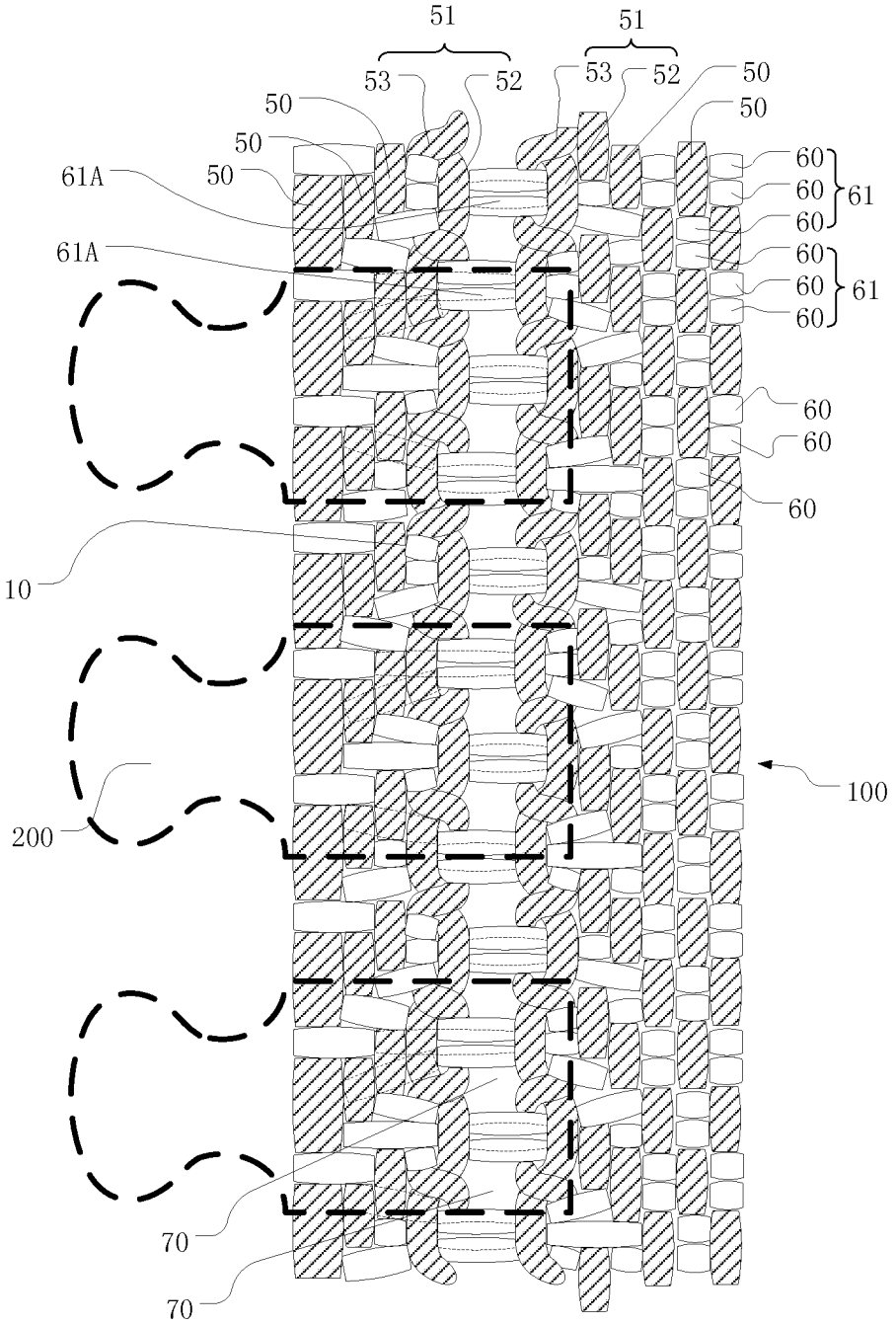
FIG. 1 is a partial diagram of a tape according to a first exemplary embodiment of the disclosure.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

FIG. 1 is a partial diagram of a tape 100 according to a first embodiment of the disclosure. The tape 100 is used for manufacturing a derlin zipper.

The tape 100 includes a bonding area 10 along a length of the tape 100. A row of hollow areas 70 are defined at the bonding area 10. A plurality of teeth 200 are positioned in order at the bonding area 10.

In the embodiment, the derlin zipper is made by a process of injection molding. During the process of molding the derlin zipper, the liquid derlin material flows into the hollow areas 70 in the bonding area 10 of the tape 100. After a cooling action, a post (not shown) is formed together with a corresponding tooth 200, and penetrates the tape 100. As a result, because the post of the tooth 200 passes through the corresponding hollow areas 70 of the tape 100, the tooth 200 fixes with the tape 100 firmly.

In particular, the hollow areas 70 in the bonding area 10 of the tape 100 are formed during a process of weaving the tape 100.

The tape 100 includes a plurality of warp yarns 50, and a plurality of weft yarns 60 interwoven with the warp yarns 50.

In the first exemplary embodiment, the plurality of warp yarns 50 includes two groups of clamping warp yarns 51 arranged in series in the bonding area 10, and each group of clamping warp yarns 51 includes a first clamping warp yarn 52, and a second clamping warp yarn 53 neighboring the first clamping warp yarn 52. The plurality of weft yarns 60 are divided into a plurality of groups of weft yarns 61 arranged in series. In the embodiment, each group of weft yarns 61 includes three weft yarns 60.

Figure 2:
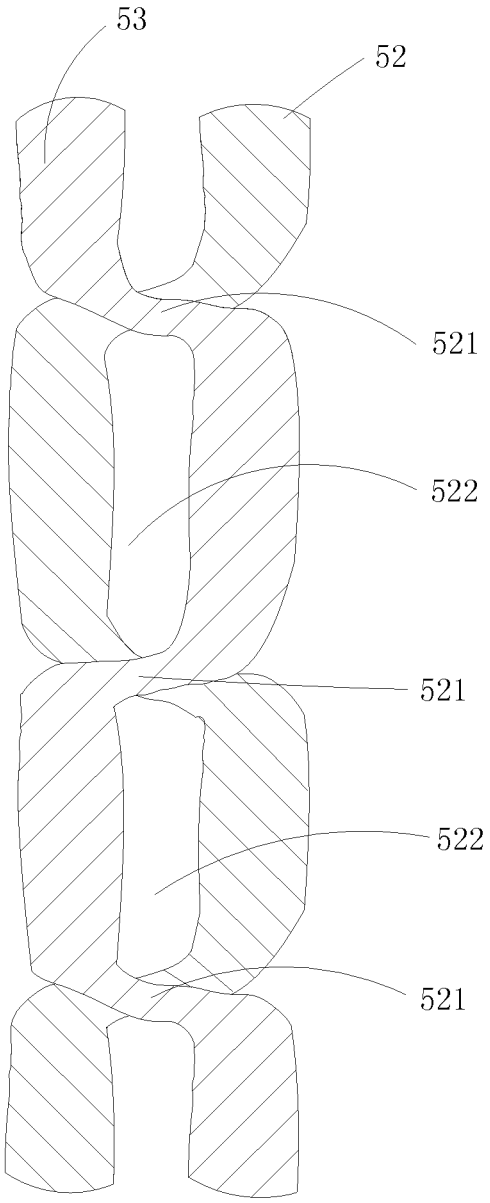
FIG. 2 is a diagram of a wriggling structure of a first clamping warp yarn and a second clamping warp yarn of FIG. 1.

With reference to FIG. 1 and FIG. 2 together, during a process of weaving the tape 100, the second clamping warp yarn 53 of each group of clamping warp yarns 51 is located under all groups of weft yarns 60. The first clamping warp yarn 52 of each group of clamping warp yarns 51 is located upon one group of the weft yarns 60. The first clamping warp yarn 52 intersects with the second clamping warp yarn 53, then wriggles down the second clamping warp yarn 53, and up a next group of weft yarns 61. The first clamping warp yarn 52 is organized as a circulation structure with wriggle of the first clamping warp yarn 52 down the second clamping warp yarn 53 and up the next group of weft yarns 61.

That is, the first clamping warp yarn 52 and the second clamping warp yarn 53 intersect with each other at positions between each two neighboring groups of weft yarns 61, so as to generate a plurality of intersections 521 formed collectively by the first clamping warp yarn 52 and the second clamping warp yarn 53, shown as FIG. 2. As a result, a clamping space 522 is formed between each two neighboring intersections 521. Each group of weft yarns 61 passes through the corresponding clamping space 522 with the first clamping warp yarn 52 located upon the group of weft yarns 61 and the second clamping warp yarns 53 located under the group of weft yarns 61. As a result, each group of weft yarns 61 is clamped by the first clamping warp yarn 52 and the second clamping warp yarn 53 tightly to form a weft yarn beam 61A, and a hollow area 70 is formed between each two neighboring weft yarn beam 61A. The row of hollow areas 70 are formed between the two groups of clamping warp yarns 51.

In other words, the first clamping warp yarn 52 and the second clamping warp yarn 53 wriggle along the length of the tape 100, and intersect with each other a plurality of times to exchange positions with each other, so as to form a plurality of clamping spaces 522. Each group of weft yarns 61 passes through the corresponding clamping space 522 with the first clamping warp yarn 52 located upon the group of weft yarns 61 and the second clamping warp yarn 53 located under the group of weft yarns 61. As a result, each group of weft yarns 61 is clamped tightly by the first clamping warp yarn 52 and the second clamping warp yarn 53. The row of hollow areas 70 are formed between the two groups of clamping warp yarns 51.

Advantageously, continuous transpositions and intersections between the first clamping warp yarn 52 and the second clamping warp yarn 53 ensure fixation and fastness of the positions of the first clamping warp yarn 52 and the second clamping warp yarn 53. As a result, even if the tape 100 undergoes a plurality of procedures before the process of injection molding of the derlin zipper, the first clamping warp yarn 52 and the second clamping warp yarn 53 fail to move, which results of stability of the positions and sizes of the hollow area 70. During the process of injection molding of the derlin zipper, the liquid derlin material flows into the hollow area 70. After a cooling action, the liquid derlin material in the hollow area 70 forms the post integrated with the tooth 200, and penetrates the tape 100. As a result, a bonding force between the tooth 200 and the tape 100 is guaranteed to improve greatly, which prevents the tooth 200 escaping from the tape 100 effectively. Manufacturers need not worry about movement of the warp yarns 50 during the manufacturing procedures of the tape 100, and the size and the position of the hollow area 70 are unchangeable.

A number of each group of weft yarns 61 is less than a number of weft yarns 60 covered by a tooth 200 of the derlin zipper. In the embodiment, because one single tooth 200 generally covers at least five weft yarns 60, and the row of hollow areas 70 of the tape 100 evenly space from each other with three weft yarns 60, the portion of the bonding area 10 corresponding to each tooth 200 covers at least one hollow area 70. Therefore, during the process of injection molding the derlin zipper using the above tape 100, it is not required to worry about positioning between the tape 100 and the injection mold for the derlin zipper, which ensures improvement of the bonding force between each tooth 200 and the tape 100. The process of injection molding the derlin zipper is simple and easy.

Alternatively, the plurality of warp yarns 50 may just include one group of clamping warp yarns 51. As a result, the size of the hollow area 4 gets smaller.

Alternatively, the plurality of warp yarns 50 may includes more than two groups of clamping warp yarns 51 arranged in series. As a result, one row of hollow areas 70 is defined between each two neighboring groups of clamping warps yarns, and the tape includes a plurality of rows of hollow areas 70.

Figure 3:
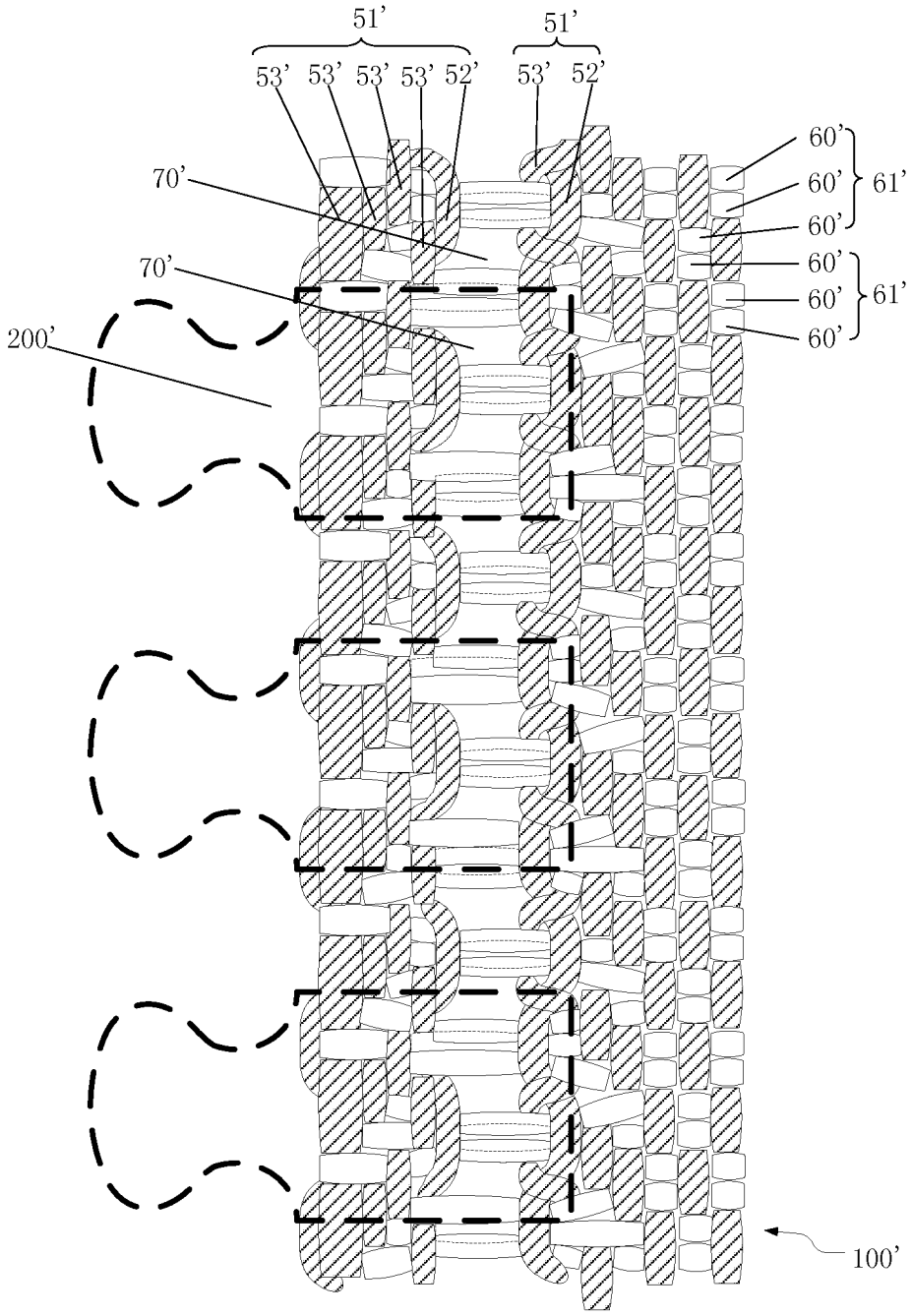
FIG. 3 is a partial diagram of the tape according to a second exemplary embodiment of the disclosure.

FIG. 3 is a partial diagram of a tape according to a second exemplary embodiment of the disclosure.

The structure configuration of a tape 100' of the second exemplary embodiment is substantially similar with that of the tape 100 of the first exemplary embodiment, but differs that one group of clamping warp yarns 51' includes a first clamping warp yarn 52', and four second clamping warp yarns 53' arranged in series. The number of the clamping warp yarn of another group of clamping warp yarns 51' and the weave of the other group of clamping warp yarns 51' are same as that of each group of clamping warp yarns 51 of the tape 100 of the first exemplary embodiment.

Figure 4:
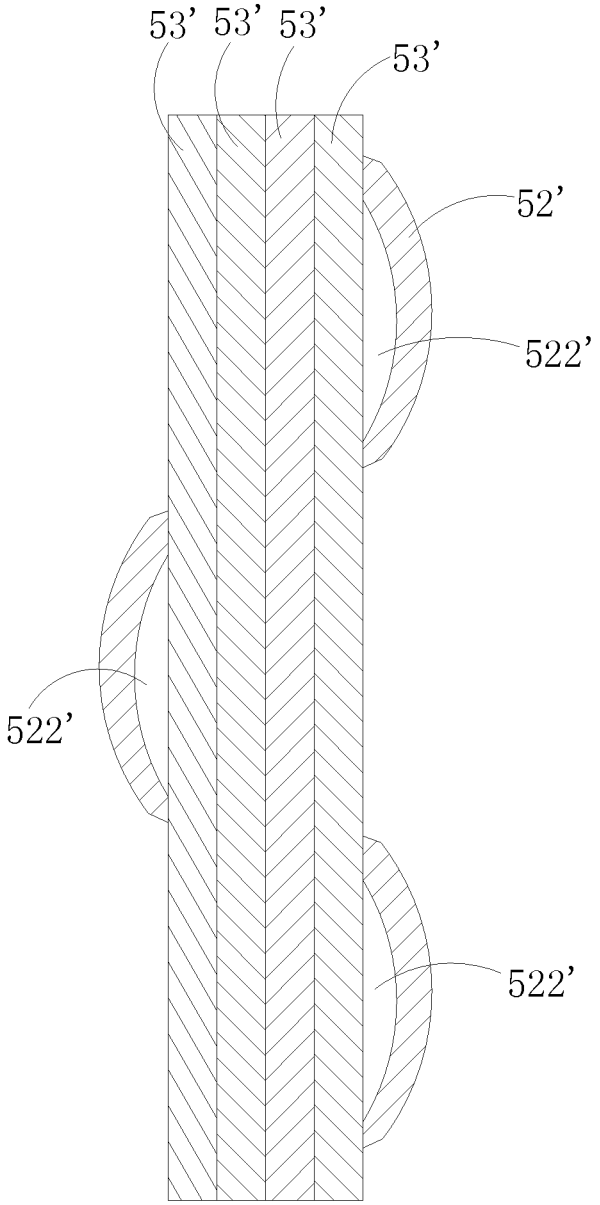
FIG. 4 is a diagram of a wriggling structure of a first clamping warp yarn of FIG. 3.
Figure 5:
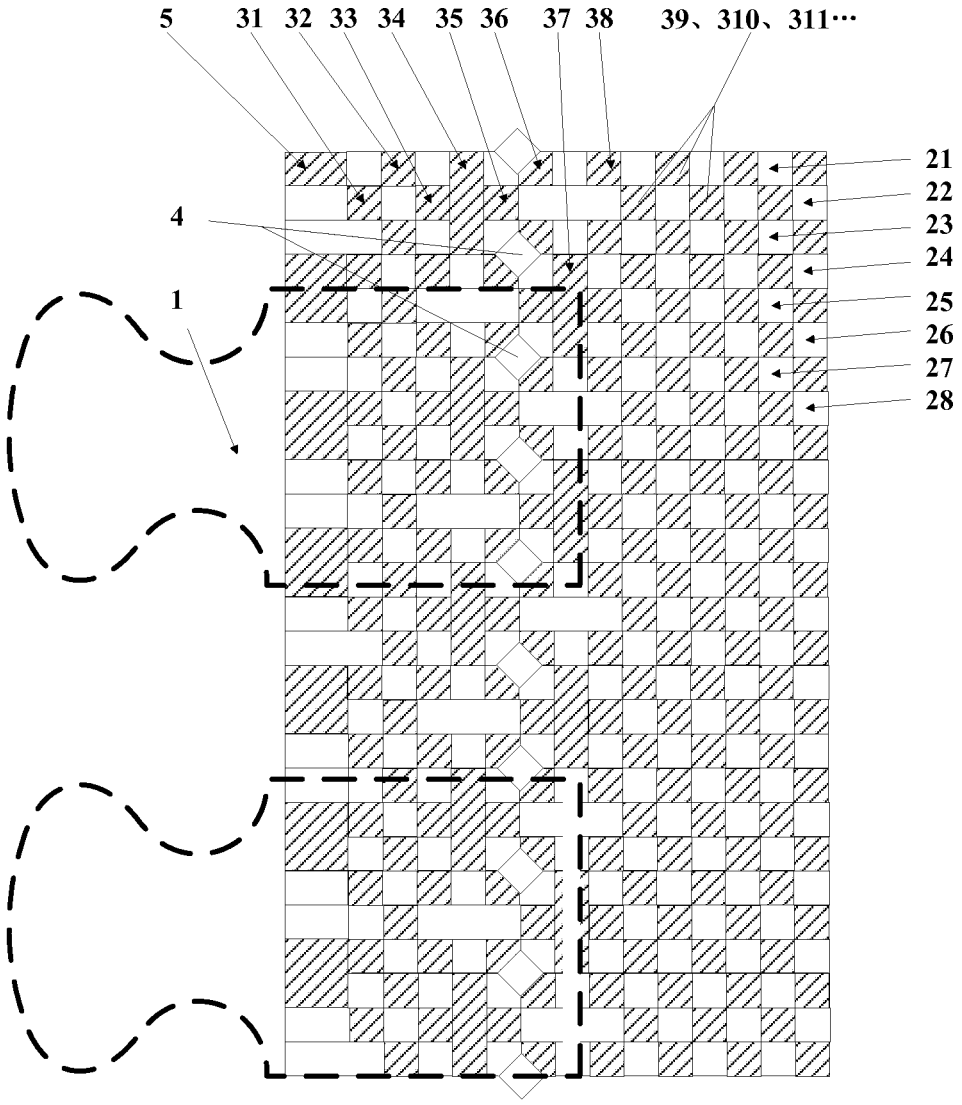
FIG. 5 (Prior Art)
FIG. 5 is a partial diagram of a prior tape for a derlin zipper.

During a process of weaving the tape 100', the first clamping warp yarn 52' of the one group of clamping warp yarns 51' wriggles along a length of the tape 100', and exchanges position with the four second clamping warp yarns 53'. That is, the four second clamping warp yarns 53' can be regarded as a whole equal to the second clamping warp yarn 53 of the first exemplary embodiment. As a result, the first clamping warp yarn 52' and the four second clamping warp yarns 53' collectively form a plurality of clamping spaces 522', shown as FIG. 4. Each group of weft yarns 61' passes through the corresponding clamping space 522'. As a result, each group of weft yarns 61' consisted of three weft yarns 60' is clamped tightly by the first clamping warp yarn 52' and the four second clamping warp yarn 53'. Simultaneously, the first clamping warp yarn 52' wriggles along the four second clamping warp yarns 53', and the first clamping warp yarn 52' and the weft yarns 60' collectively clamp the four second clamping warp yarns 53' tightly, which results that the size of the hollow area 70' is larger than that of the hollow area 70 of the first exemplary embodiment. That is, the hollow area 70' extends toward the orientation of the warp yarns 50' of the tape 100'. Apparently, the bonding force between the tooth 200' and the tape 100' of the second exemplary embodiment is greater than that of the first exemplary embodiment.

The weaving structure of the tape 100, 100' of the derlin zipper is not limited to the above weaving structure of the two exemplary embodiments. Any tape with weaving structure that the warp yarns clamp the weft yarns, and the warp yarns winds each other to form the rows of the hollow areas 70, 70', falls into the scope of the protection of the tap 100, 100' of the disclosure.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A tape for a derlin zipper, comprising a plurality of warp yarns and a plurality of weft yarns interwoven with the plurality of warp yarns, the plurality of weft yarns divided into a plurality of groups of weft yarns, wherein the plurality of warp yarns comprises at least one group of clamping warp yarns arranged in series, and each group of clamping warp yarns comprises a first clamping warp yarn and at least one second clamping warp yarn, and wherein the first clamping warp yarn and the second clamping warp yarn intersect with each other at positions between each two neighboring groups of weft yarns, to generate a plurality of intersections formed collectively by the first clamping warp yarn and the second clamping warp yarn, a clamping space is formed between each two neighboring intersections, the first clamping warp yarn, the second clamping warp yarn and each two neighboring intersections cooperatively form the clamping spaces, each group of weft yarns passes through a corresponding clamping space with the first clamping warp yarn located upon the group of weft yarns and the second clamping warp yarn located under the group of weft yarns, and each group of weft yarns having at least two weft yarns is clamped by the first clamping warp yarn, one corresponding clamping space and the second clamping warp yarn tightly to form a weft yarn beam, and wherein a hollow area is formed between each two neighboring weft yarn beams.

2. The tape of claim 1, wherein the plurality of warp yarns comprises two groups of clamping warp yarns arranged in series, and one row of hollow areas are formed between the two groups of the clamping warp yarns.

3. The tape of claim 1, wherein one group of the clamping warp yarns has four second clamping warp yarns, and the first clamping warp yarn and the plurality of groups of weft yarns collectively clamp the four second clamping warp yarns tightly.

4. The tape of claim 1, wherein a number of weft yarns of each group of weft yarns is less than a number of weft yarns covered by a tooth of the derlin zipper.

5. The tape of claim 4, wherein each group of weft yarns has three weft yarns.

6. A tape for a derlin zipper, comprising a plurality of warp yarns and a plurality of weft yarns interwoven with the plurality of warp yarns, the plurality of weft yarns divided into a plurality of groups of weft yarns, wherein the plurality of warp yarns comprises at least one group of clamping warp yarns arranged in series, and each group of the clamping warp yarns comprises a first clamping warp yarn and at least one second clamping warp yarn, the first clamping warp yarn and the second clamping warp yarn wriggle along a length of the tape to exchange positions with each other, and to collectively form a plurality of intersections and clamping spaces, the first clamping warp yarn, the second clamping warp yarn and each two neighboring intersections cooperatively form the clamping spaces, each group of weft yarns having at least two weft yarns passes through the corresponding clamping space with the first clamping warp yarn located upon the group of weft yarns and the second clamping warp yarn located under the group of weft yarns, and is clamped by the first clamping warp yarn and the second clamping warp yarn, and wherein a hollow area is formed between each two neighboring groups of weft yarns.

7. The tape of claim 6, wherein the plurality of warp yarns comprises two groups of clamping warp yarns arranged in series, and one row of hollow areas are formed between the two groups of the clamping warp yarns.

8. The tape of claim 6, wherein each group of clamping warp yarns comprises four second clamping warp yarns, and the first clamping warp yarn and the plurality of groups of weft yarns collectively clamp the four second clamping warp yarns tightly.

9. The tape of claim 6, wherein a number of weft yarns of each group of weft yarns is less than a number of weft yarns covered by a tooth of the derlin zipper.

10. The tape of claim 9, wherein each group of weft yarns has three weft yarns.

11. A tape for a derlin zipper, comprising a plurality of warp yarns and a plurality of weft yarns interwoven with the plurality of warp yarns, the plurality of weft yarns divided into a plurality of groups of weft yarns, wherein the plurality of warp yarns comprises at least one group of clamping warp yarns arranged in series, and each group of the clamping warp yarns comprises a first clamping warp yarn and at least one second clamping warp yarn, the second clamping warp yarn of each group of clamping warp yarns is located under all groups of weft yarns, the first clamping warp yarn is organized as a circulation structure that the first clamping warp yarn is located upon one group of the weft yarns, then the first clamping warp yarn intersects with the second clamping warp yarn, and wriggles down the second clamping warp yarn, and subsequently up a next group of weft yarns.

12. The tape of claim 11, wherein the plurality of warp yarns comprises two groups of clamping warp yarns arranged in series, and a row of hollow areas are formed between the two groups of the clamping warp yarns.

13. The tape of claim 11, wherein each group of clamping warp yarns comprises four second clamping warp yarns, and the first clamping warp yarn and the plurality of groups of weft yarns collectively clamp the four second clamping warp yarns tightly.

14. The tape of claim 11, wherein a number of weft yarns of each group of weft yarns is less than a number of weft yarns covered by a tooth of the derlin zipper.

15. The tape of claim 14, wherein each group of weft yarns has three weft yarns.

* * * * *